United States Patent [19]

Battrick

[11] 4,237,754

[45] Dec. 9, 1980

[54] UNIVERSAL SPUD WRENCH

[75] Inventor: Calvin H. Battrick, Cambria, Calif.

[73] Assignee: Raymond W. Trout, Atascadero, Calif.; a part interest

[21] Appl. No.: 56,892

[22] Filed: Jul. 12, 1979

[51] Int. Cl.[3] ..... B25B 13/48

[52] U.S. Cl. ..... 81/439; 81/90 D; 81/436

[58] Field of Search ..... 81/71, 90 R, 90 C, 90 D

[56] References Cited

U.S. PATENT DOCUMENTS

| | | | |
|---|---|---|---|
| 2,956,461 | 10/1960 | Anderson | 81/71 |
| 3,086,414 | 4/1963 | Nardi | 81/90 D |
| 3,156,141 | 11/1964 | Pluntz | 81/90 D X |

FOREIGN PATENT DOCUMENTS

| | | | |
|---|---|---|---|
| 1053707 | 9/1953 | France | 81/90 D |

*Primary Examiner*—James G. Smith

*Attorney, Agent, or Firm*—Henry M. Bissell

[57] ABSTRACT

A universal spud wrench designed for rapid installation and removal of all types of spuds from drains, etc., including a tubular shaft having four perpendicularly oriented sloped surfaces forming slots, and aligned extensions adjacent said slots which are defined by differing diameters about a central axis.

5 Claims, 6 Drawing Figures

UNIVERSAL SPUD WRENCH

BACKGROUND OF THE INVENTION

1. Field of the Invention

The invention principally relates to a wrench for installation and removal of bathtub, sink and water closet spuds or other waste or overflow drains.

2. Description of the Prior Art

Numerous designs for "spud wrenches" exist. They are used to install and remove the brass or chrome plated seal on a bathtub or a sink drain, or waste disposal drains. Before or after the drain is in place, especially in drains such as bathtub drains, it is often difficult to reach the underside of the drain, in order to position a wrench to install or remove the spud or seal. As a result, there is a need in the art to provide a tool for quick and easy installation or removal of such seals when water supply and/or drain systems are changed, or the tub, sink, etc. is changed.

In the art, items such as a U-shaped wrench having a movable arm are known. However, such a U-shaped type wrench obviously lacks the capability to be placed in contact with more than two surfaces in the spud. Basket strainer spuds for laundry tubs or sinks, etc. often have a four sided web for positioning of the strainers, and very often have a circular cut-out in the center of the four sided web. In the alternative, bathtubs, for instance, typically have a circular spud having four projections toward the center. The known U-shaped spud wrench would not be capable of contacting more than two of the projections in a tub, or two surfaces of the web shape design normally used in laundry tubs and sinks. Thus, the ease of operation of this type of unit could be significantly improved upon.

In another form, an expandable eccentric having knurled gripping faces is known. The eccentric obviously suffers from the disability of being severely limited in its use in the web shaped structures. Only a limited portion of its face can be placed above the web, and the knurled surface could damage the surface of the drain.

Thus, it appears desirable to provide a universal spud wrench which will, upon positioning in a spud, come in close surface contact with all of the projections or web structures in the spud. Such a tool will provide simple, close contact with the plural extensions or web shaped surfaces of the spud, and thus provide a mechanical advantage over the known art and facilitate the removal of the spud.

SUMMARY OF THE INVENTION

In the plumbing art, presently, it is very hard to install or remove a spud from a sink, water closet or bathtub, as there is no simple universal tool provided or designed to utilize the web structure, or the internal projections of a spud in the drain portion thereof to transmit the applied torque to the thread portion of the spud. Simple means normally utilized include those indicated above, and thus the present invention is designed, in its most preferred form to provide a single wrench to install and extract various types and sizes of spuds.

To this end a tubular shaft is utilized, and on either end of the tubular shaft, separate spud removal devices are provided. In one form, a structure of a tubular nature is provided with four symmetrical extensions or protrusions, each of which has an inner surface defined by an arc having the same axis as the tubular structure, an outer surface defined by a slightly larger diameter arc, and opposing sides defined by radii of the circles. These extensions can vary in length, but are comonly approximately $\frac{1}{4}$ of an inch. The space between these extensions is commonly 5/16 of an inch each, but may vary somewhat depending upon the desired sizes. The extension forms a slot which is continued along the next longitudinally inward surface, formed by the larger diameter arc, each slot extending radially away from the axis of the hole of the tool in a longitudinal direction toward the handle or center of the tool. The resulting tool would then have a first smaller set of extensions for use in a first size of spud, and with the outward slope, would have a second set of extensions which could be used in a larger spud. The same basic structure could be duplicated on both ends of the tool of the present invention and, thus, the tool can be utilized on at least four distinct sizes of spuds.

At one end, the outside diameter of the first extensions could be, for example, 1.310 inches, thus could be used for a $1\frac{3}{8}$ I.D. spud. The second or larger section on the smaller end would be, for example, 1.480 inches in outside diameter, and thus could be used for $1\frac{1}{2}$ inch inside diameter spud. In this form, in the preferred embodiment, the slots would be spaced approximately $\frac{3}{8}$ inch apart, to allow for the spacing for the web structure, or for the protrusions of the spud to be placed next adjacent to the wrench. On the other end, a 1.585 inch outside diameter for the first extension is preferred, thus allowing for the use of the wrench of the present invention on a $1\frac{5}{8}$ inch I.D. spud. A preferred form for the second or larger, stepped out portion of the wrench on the same end would be 1.650 inches allowing for the use of the wrench of the present invention in an 1 11/16 inch inside diameter spud. In this particular case, it would be preferable to utilize 5/16 inch as the space between extensions which form the slot or cut-out to allow for larger webbing in the spud. In addition, in this particular embodiment, in view of the larger size, it would be most preferable to provide for a cylindrical lip on the inside of the smaller of the extensions in order to strengthen the tool, as the larger diameter spuds require more torque to remove.

Thus, in its most preferred form, the present invention contemplates a single tool having, for instance, a slide bar centrally located for turning, and having extensions on either ends of the cylinder which locates the slide bar. These tool extensions, are formed as four symmetrical arced pieces, with an axis common with that of the cylinder. Radially aligned cutouts or slots define the four extensions along with a first smaller concentric diameter and a second larger concentric diameter which extends longitudinally inward from the first diameter. The second set of faces of the tool has an inside diameter equal to the outside diameter of the first set, but has a larger concentric outside diameter and utilizes the common slots which are radially sloped toward the outside diameter of the hole of the tool. The resulting tool could be utilized for an internal diameter spud of the web shape, the basket shape, or one with protrusions from $1\frac{3}{8}$ to 1 11/16 inches or more in the most common forms of spuds, and thus provide a single universal tool which may be efficiently utilized to insert or remove most spuds.

DESCRIPTION OF THE DRAWINGS

A better understanding of the present invention may be had from a consideration of the following detailed description, taken in conjunction with the accompanying drawings in which.

In these drawings, in all cases, the letter A corresponds to the first end, the letter B corresponds to the second end of the wrench of the present invention.

DESCRIPTION OF THE PREFERRED EMBODIMENTS

Figure 1A:
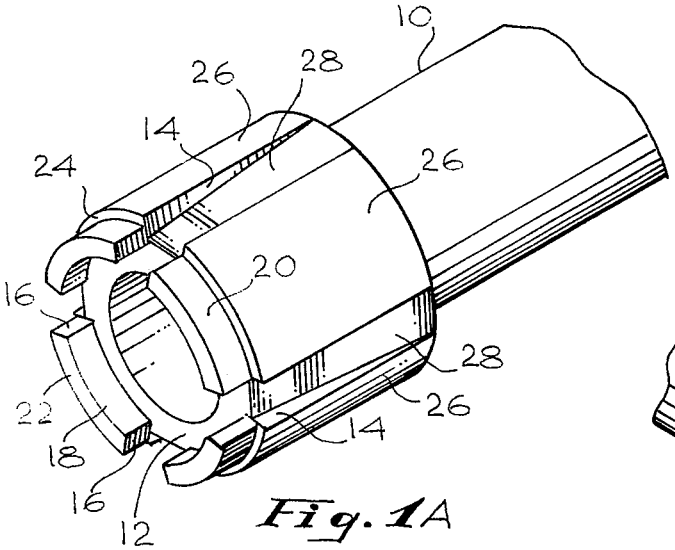
FIGS. 1A and 1B represent isometric sections of either end of a spud wrench.

In FIG. 1A, the first end of the tool of the present invention is shown in isometric section showing main shaft 10, and the portion of the tool shown at one end wherein facing surface 12 has upon it four extensions defined by concentric surfaces 18 and 20 terminating on end surface 22, and having as their ends radial surfaces 16. The gaps between surfaces 16 are normally 5/16 of an inch in the most preferred form of the present invention, and the diameter used to define surfaces 18 is normally 1.375 inches. Total inside diameter of the face surface 12 is usually 1.00 inches, but can vary depending upon the strength desired in the tool. Raised portion 24 is provided at the four spaces or slots as defined by the extensions previously described, with an outside diameter of 1.650 inches, and an inside diameter of 1.585 inches. This inside diameter is also the diameter of surface 20, and the 1.650 inch diameter defines flat surface 26 of the second portion of this end of the tool of the present invention. Slots, 28, extends from surface 12 along the whole of the length of the second mating face of this end of the tool, and are sloped radially outward from the center line of the axis of the tool of the present invention. In the preferred embodiment the slots end at the same location, and with the same diameter as surface 26. As a result of this design, the extensions, formed by sub faces 16, 18, 20 and 22 form a tool surface capable of installing and removing certain commonly found spuds. In addition, a larger surface utilizing the same end of the tool is available for the installation and removal of larger spuds by further inserting the tool into the spud, and thus engaging surfaces 14 and 26 of the upper larger diameter section of the tool of the present invention.

Figure 1B:
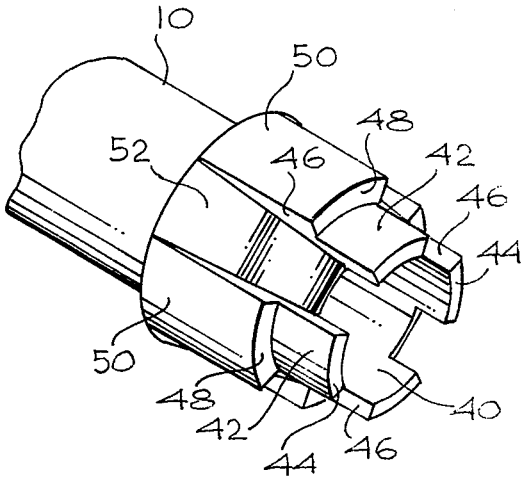

In FIG. 1B, cylindrical tool shaft 10 is shown in isometric view again, but in this case the other end of the tool of the present invention is shown. Here, the extensions take the form of inner circular surface 40, outer circular or arced surfaces 42, end surfaces 44 and radial surfaces 46. In this embodiment smaller diameter spuds are capable of being removed, and thus it is not necessary to provide the larger surface shown in FIG. 1A, and thus the internal diameter defined by surface 40 is normally 1.00 inches, and the external diameter defined by surface 42 is normally 1.310 inches. The same extensions for use in the smaller diameter first portion of this second end of the tool of the present invention is provided in this form. In addition, smaller outside diameter arced surface 42 terminates at surface 48 and larger diameter arced surface 50, commonly 1.480 inches, abuts surface 48 form a new tool face. This outer surface 50 defines, in conjunction with the extensions of radial surfaces 46, a separate tool surface for the removal of larger spuds. In this embodiment of the present invention, surface 52 is again a sloped face, initiating at a point longitudinally inward from the extensions of the first portion of the tool and sloping radially outward along the axis of the tool of the present invention, to the end of the larger tool face, where it joins with, and has the same diameter as, surface 50. In this form, two more surfaces are provided for the easy use of the present tool, to install and to remove spuds from drains, etc.

In combination, the two ends of the tool shown in FIG. 1A and FIG. 1B provide four spud installation or removal surfaces, and can be carried as a single tool, but provide for the installation and removal of many separate types of spuds. The main portion of tool body 10 is cross drilled, perpendicular to the axis of the tube, and a shaft placed through the center of the tool, or at another convenient position along the tube, in order to provide a means to turn the tool of the present invention once it has been engaged with the spud which is to be removed by it.

Figure 2A:
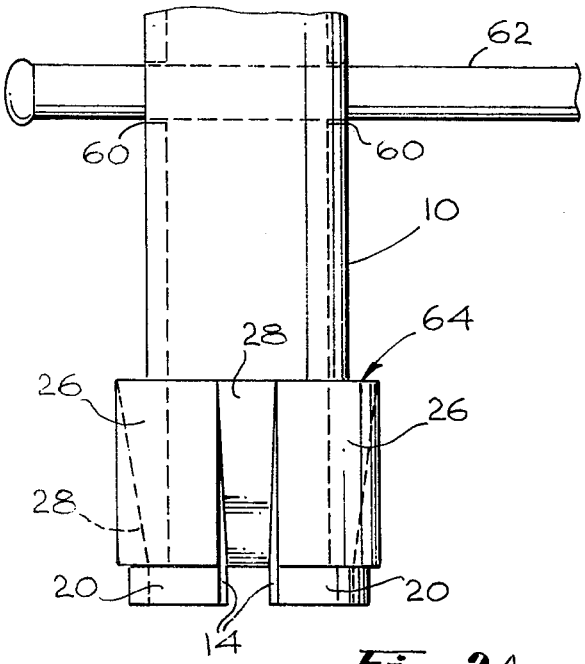
FIG. 2A shows a top view of one end of the wrench.

In FIG. 2A, tubular shaft 10 is shown cross drilled at points 60, with shaft 62 placed therethrough in a slidable manner so that the turning of the tool of the present invention is facilitated. Shaft 10 is attached to tool head 64, and, as in FIG. 1A, radial slot surfaces 14 are adjacent sloped surface 28, and join with surface 26 to form the larger second wrench mating surface of the tool. In addition radial surfaces 14 also join to smaller arced tool surface 20 to form the external surface of the smaller extended tool head on this end of the wrench.

Figure 2B:
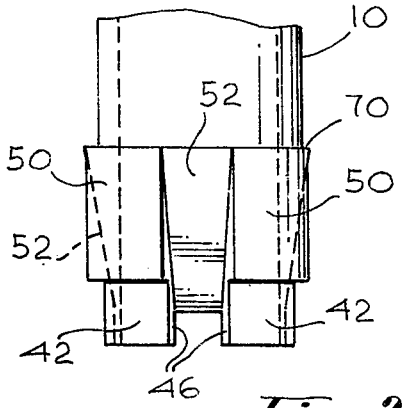
FIG. 2B shows the top view of the other end of the wrench.
Figure 3A:
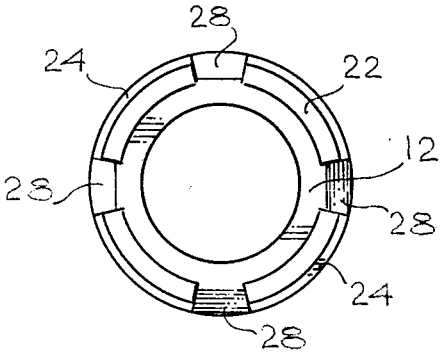
FIG. 3A shows an end view of one end of the wrench of the present invention.

In FIG. 3A, the end view of the section shown in FIG. 2A is depicted. Surface 12, shown in its full circular form, has the extensions formed by surface 22, and surfaces 16, 18 and 20 (not shown). In addition, sloping slot surface 26 is depicted and the portion of the surface 24 that forms the joint between the extended tool surface (of smaller diameter) and the larger tool surface (26 shown only as a line in this drawing) is shown In FIG. 2B, cylindrical shaft 10 connects to the second tool head of the present invention, at 70 and this top view shows extensions 42, and radial surfaces 46 as they form the smaller of the tool heads on this end of the tubular shaft, as well as sloped surface 52 formed by the edges of radial surfaces 46, and external mating surface 50 for the larger portion of the tool on this end. It should be noted, that in this embodiment of the tool of the present invention, the sloped surfaces reach the initial external diameter of the larger of the two tool surfaces at a point prior to the junction with cylindrical shaft 10. At this point, both the sloped surfaces and the tool surface 50 become sightly inclined, and the result is a flare at this end of the tool surface in order to facilitate mating to various size spuds.

Figure 3B:
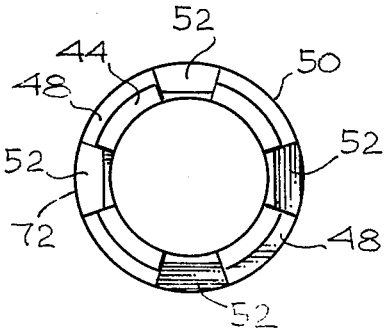
FIG. 3B shows an end view of the other end of the wrench.

FIG. 3B is an end view of the tool shown in FIG. 2B, and depicts the spatial relationship more clearly. The internal space between slot surfaces 46, slope surface 52 is $\frac{3}{8}$ inch, and the slope surface begins at a point which is preferably 0.030 inches outside the diameter of the inner circle formed by the material as measured, along a radial bisecting the angle formed by the two radii producing slot surfaces 46. The extensions formed by surfaces 40, 42, and 44 are shown in planar view as surface 44, and the junction surface 48 between the smaller and the larger tool surfaces of the present invention is shown in planar view as well. In addition, larger circle 72 shows the flared outside diameter produced by the extension of sloped surfaces 52 past the diameter of the initial portion of tool surface 50 (not shown).

Although there have been described above specific arrangements of a universal spud wrench for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. A multi-purpose spud wrench comprising:

(a) a shaft with means for rotating said shaft about its axis;

(b) plural perpendicularly oriented slots accommodating spud surfaces on at least one end of said shaft;

(c) a first set of plural extensions defined by (1) an inside surface of said wrench;

(2) radial extensions forming said slots; and (3) a first outside arced surface coaxial with said shaft; and (d) second plural extension adjacent said first extensions, defined by:

(1) said inside surface of said wrench;

(2) said plural radial extensions; and (3) a second larger outside arced surface coaxial with said shaft; and said slots being adjacent said first and second extensions, and sloping relatively outwardly from said first extension to said second outside diameter.

2. The wrench of claim 1 wherein two sets of the extension structure are provided and are attached to both ends of said shaft.

3. The wrench of claim 2 wherein said second arced surface and said slots join to form a circular surface equal to the diameter of said second arced surface at one end of said wrench and a surface greater in diameter than the diameter of said second arced surface at the other end of said wrench.

4. The wrench of claim 2 wherein one set of said slots is $\frac{3}{8}''$ in width and a second set of said slots, at the second end of said wrench is 5/16″ in width.

5. The wrench of claim 2 wherein the diameter defined by said first arced surface is 1.310 inches, and the diameter defined by said second arced surface is 1.480 inches at one end of said wrench, and the diameter defined by said first arced surface is 1.585 inches and the second arced surface is 1.650 inches at the other end of said wrench.

* * * * *